US008220890B2

(12) United States Patent
Hashi

(10) Patent No.: US 8,220,890 B2
(45) Date of Patent: Jul. 17, 2012

(54) INKJET PRINTER AND METHOD FOR CONNECTING INK CARTRIDGES

(75) Inventor: Hiroshi Hashi, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 305 days.

(21) Appl. No.: 12/694,494

(22) Filed: Jan. 27, 2010

(65) Prior Publication Data

US 2010/0194796 A1 Aug. 5, 2010

(30) Foreign Application Priority Data

Jan. 30, 2009 (JP) ..... 2009-020220

(51) Int. Cl.
*B41J 2/195* (2006.01)
*B41J 29/393* (2006.01)
*B41J 2/175* (2006.01)

(52) U.S. Cl. ..... 347/7; 347/19; 347/85; 347/86

(58) Field of Classification Search ..... 347/7, 19, 347/85, 86

See application file for complete search history.

(56) References Cited

FOREIGN PATENT DOCUMENTS

JP 2003-246079 A 9/2003

*Primary Examiner* — Julian Huffman

(74) *Attorney, Agent, or Firm* — Holtz, Holtz, Goodman & Chick P.C.

(57) ABSTRACT

In an inkjet printer, ink cartridges are set individually in predetermined positions of a cartridge holder portion. Information on the ink cartridges is read by read portions and it is determined whether or not the ink cartridges are adaptive. If all the ink cartridges set in the predetermined positions of the cartridge holder portion are determined to be adaptive, a drive unit is driven to perform a connecting operation.

16 Claims, 14 Drawing Sheets

INKJET PRINTER AND METHOD FOR CONNECTING INK CARTRIDGES

CROSS-REFERENCE TO RELATED APPLICATIONS

This application is based upon and claims the benefit of priority from prior Japanese Patent Application No. 2009-020220, filed Jan. 30, 2009, the entire contents of which are incorporated herein by reference.

BACKGROUND OF THE INVENTION

1. Field of the Invention

The present invention relates to an inkjet printer comprising removable ink cartridges and a method for mounting ink cartridges.

2. Description of the Related Art

There are known inkjet printers in which inks supplied from removable ink cartridges are discharged from recording heads onto recording media for image recording.

In the inkjet printers of this type, a plurality of ink cartridges are mounted on a holder to effect high-quality recording. In some cases, however, these ink cartridges may be wrongly mounted on the holder. To avoid this, for example, each ink cartridge may be formed with indentations for wrong attachment prevention.

If each ink cartridge is formed with the indentations, however, its production costs are increased, and in addition, its shape or pattern is restricted.

An inkjet recording apparatus that can solve these problems is described in Jpn. Pat. Appln. KOKAI Publication No. 2003-246079. This recording apparatus comprises reading means, moving means, and determining means. The reading means reads identification information attached to an ink container that is mounted on an ink container holder. The moving means moves an ink supply needle and the ink container mounted on the ink container holder between first and second positions. In the first position, the needle and container is separated from one another. In the second position, the needle is stuck in the container so that ink can be supplied to a recording head through them. Further, the determining means determines whether or not to move the needle and container to the second position, based on the result of reading by the reading means.

In this inkjet recording apparatus, the reading means reads the identification information of each ink container every time the ink container is mounted on the ink container holder. Based on the result of reading, if the identification information of the ink container is determined to be appropriate, a motor (drive source) is driven to move the ink container and/or its corresponding ink supply needle. Thereupon, mounting (or connecting) the container and needle is finished.

BRIEF SUMMARY OF THE INVENTION

According to an embodiment of the present invention, there is provided an inkjet printer comprising a plurality of ink cartridges each comprising an ink containing portion which contains an ink, a first joint portion through which the ink contained in the ink containing portion is caused to flow out, and a storage medium stored with information on the ink contained in the ink containing portion, a holder portion comprising a holding member which removably holds the ink cartridges in predetermined positions, individually, a plurality of second joint portions spaced from the respective first joint portions of the ink cartridges held in the predetermined positions and disposed corresponding individually to the ink cartridges held by the holding member, and a plurality of read portions which are disposed corresponding individually to the ink cartridges held by the holding member and read the respective storage media of the ink cartridges held in the predetermined positions, a drive unit which moves the second joint portions in such a direction that the second joint portions are connected individually to respective first joint portions of the corresponding ink cartridges, and a control unit which controls drive of the drive unit based on information read by the read portions, the control unit being configured to start driving the drive unit after determining all pieces of the information read individually by the read portions to be appropriate.

According to an embodiment of the present invention, there is provided a method for connecting a plurality of ink cartridges and a plurality of joint portions in an inkjet printer which comprises the ink cartridges, which each contains an ink and to which a storage medium stored with information on the ink are attached, and a cartridge holder, which holds the ink cartridges and comprises the joint portions connected individually to the ink cartridges, the connecting method comprising:

a step of setting the ink cartridges in predetermined positions separate from the joint portions of the cartridge holder; a step of reading the storage medium of the ink cartridges set in the predetermined positions and determining whether or not the ink cartridges are adaptive; and a step of moving the joint portions toward the ink cartridges, thereby connecting the joint portions and the ink cartridges, after all the ink cartridges set in the predetermined positions of the cartridge holder are determined to be adaptive.

DETAILED DESCRIPTION OF THE INVENTION

Embodiments of the present invention will now be described with reference to the accompanying drawings.

First Embodiment

Figure 1B:
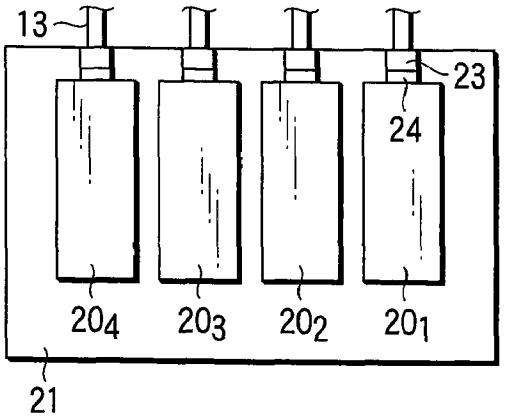
FIG. 1B is a top view of an ink supply unit according to the invention.
Figure 1A:
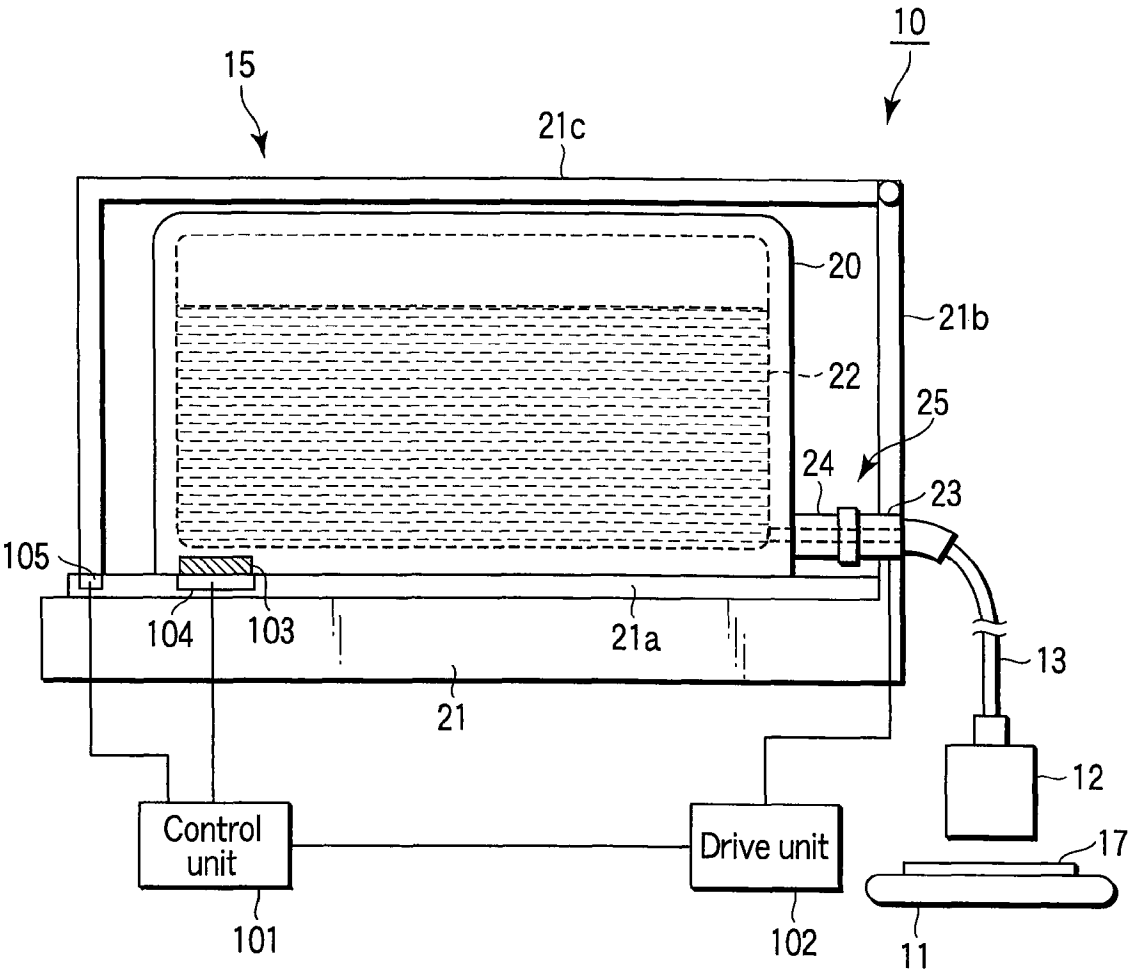
FIG. 1A is a side view showing a state in which first and second joint portions are connected to each other according to the invention.
Figure 2B:
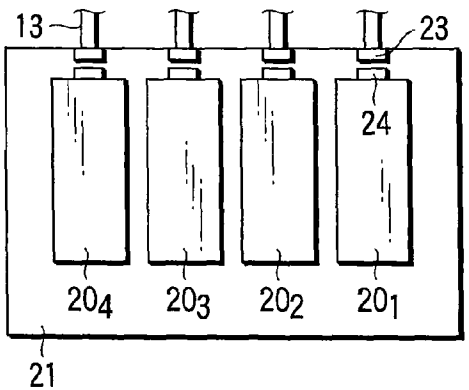
FIG. 2B is a top view of the ink supply unit according to the invention.
Figure 2A:
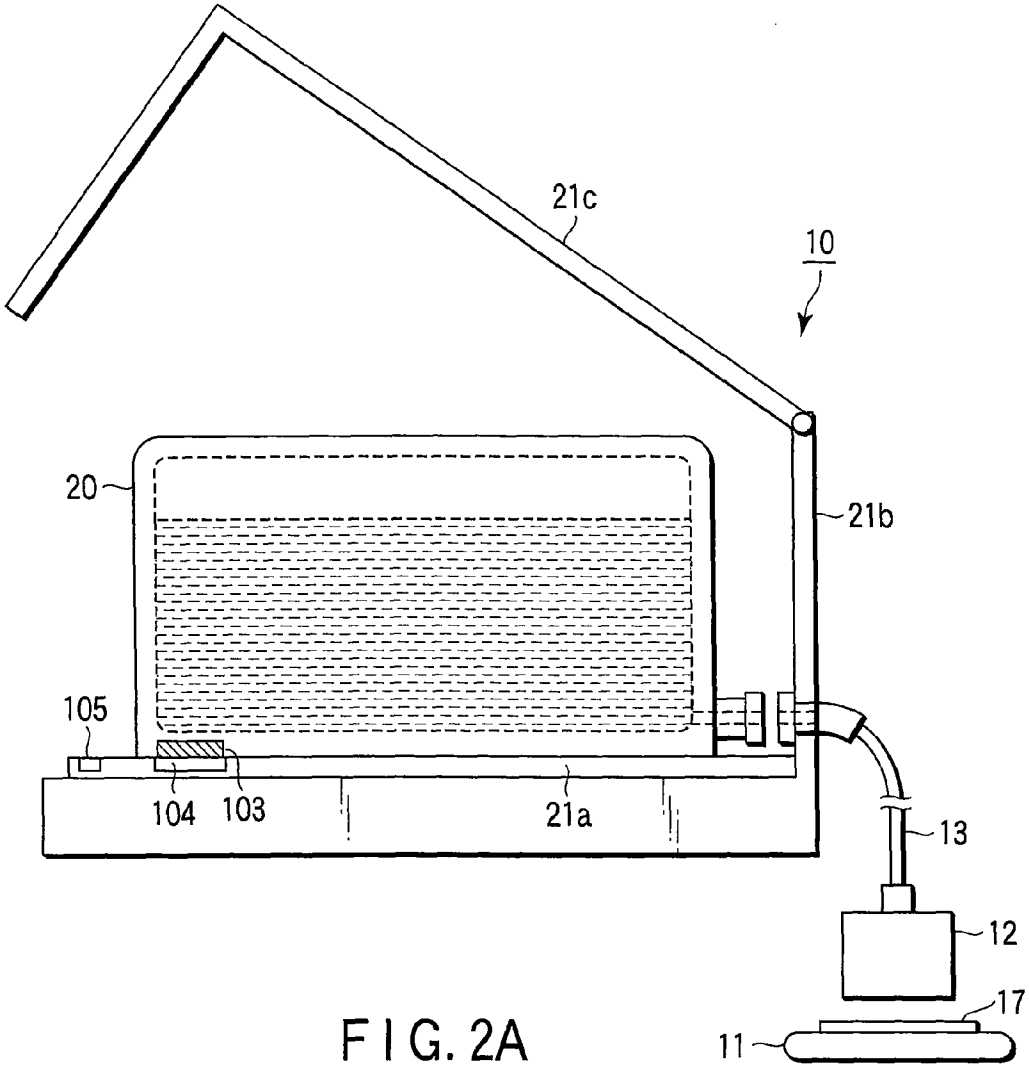
FIG. 2A is a side view showing a state in which first and second joint portions are not connected to each other according to the invention.

FIG. 1A is a side view showing a state in which first and second joint portions are connected to each other according to the invention. FIG. 1B is a top view of an ink supply unit. Further, FIG. 2A is a side view showing a state in which first and second joint portions are not connected to each other according to the invention. FIG. 2B is a top view of the ink supply unit.

As shown in FIGS. 1A to 2B, an inkjet printer 10 of the present invention comprises a conveying unit 11, recording unit 12, ink supply unit 15, and control unit 101 for controlling the entire printer 10. The conveying unit 11 conveys a recording medium 17, such as paper or film, on which images are recorded. The recording unit 12 discharges ink onto the recording medium 17. The ink supply unit 15 supplies inks of predetermined colors to the recording unit 12 through supply tubes 13, individually.

The inkjet printer 10 records a desired image on the recording medium 17 as the recording unit 12 discharges the inks onto the recording medium 17 conveyed by the conveying unit 11. The recording unit 12 according to the present embodiment may be of a line or serial type.

The following is a description of the ink supply unit 15.

The ink supply unit 15 comprises a plurality of ink cartridges 20 ($\mathbf{20}_1$, $\mathbf{20}_2$, $\mathbf{20}_3$, $\mathbf{20}_4$), cartridge holder portion 21 (hereinafter referred to as the holder portion 21) on which the cartridges 20 are mounted, and drive unit 102.

The ink cartridges $\mathbf{20}_1$ to $\mathbf{20}_4$ shown in FIG. 1B contain inks of different colors, black (K), cyan (C), magenta (M), and yellow (Y), respectively. Further, the number of ink cartridges 20 is not limited to four and may be set arbitrarily.

Each ink cartridge 20 comprises an ink containing portion 22 containing its corresponding ink, first joint portion 24, and storage portion 103 for storing information. The first joint portion 24 is one connecting portion of a joint portion 25.

The ink cartridges 20 contain the inks of the predetermined colors and are removably mounted on the holder portion 21. The storage portion 103 attached to each ink cartridge 20 is a storage medium such as an IC memory. In order to prevent non-adaptive ink cartridges from being mounted on the holder portion 21, this IC memory is loaded with information for use in the printer, information for suitably controlling recording operation, etc. More specifically, the IC memory is loaded with identification information (trade name, serial number, etc.) on each ink cartridge 20, information (color, type, life, etc.) on each contained ink, and the like.

The holder portion 21 comprises a holding member, which removably holds the ink cartridges 20. The holding member comprises a bottom portion 21*a* extending horizontally, a side portion 21*b* extending at right angles to the bottom portion 21*a* and cover 21*c*.

The bottom portion 21*a* contacts a bottom surface of each ink cartridge 20 to hold the cartridges 20 when the cartridges 20 are mounted on the holder portion 21. Further, the bottom portion 21*a* is provided with a read portion 104 and interlocking portion 105.

The read portion 104 reads information from the storage portion 103 attached to each ink cartridge 20 and notifies the control unit 101 of the read information. In the present embodiment, the read portion 104 is located in a position where it faces the storage portion 103 when each ink cartridge 20 is held in a predetermined position (mentioned later) on the holder portion 21. Here, a plurality of read portions 104 are provided on the bottom 21*a* of the holder portion 21 in such a manner that the number of read positions 104 corresponds to the number of ink cartridges 20.

The interlocking portion 105 detects whether or not the cover 21*c* is closed and notifies the control unit 101 of the result of the detection. Any sensor may be used for the interlocking portion 105 only if it can determine whether or not the cover 21*c* is open or closed.

A second joint portion 23 is provided on the side portion 21*b*, corresponding to each ink cartridge 20. Since the four ink cartridges $\mathbf{20}_1$ to $\mathbf{20}_4$ are used in the present embodiment, the second joint portions 23 are also four in number. Each second joint portion 23 is the other connecting portion of the joint portion 25.

Further, the side portion 21*b* is fitted with the cover 21*c* that is swingable around its top end. The cover 21*c* is swingable between a closed state shown in FIG. 1A and an open state shown in FIG. 2A.

Figure 3:
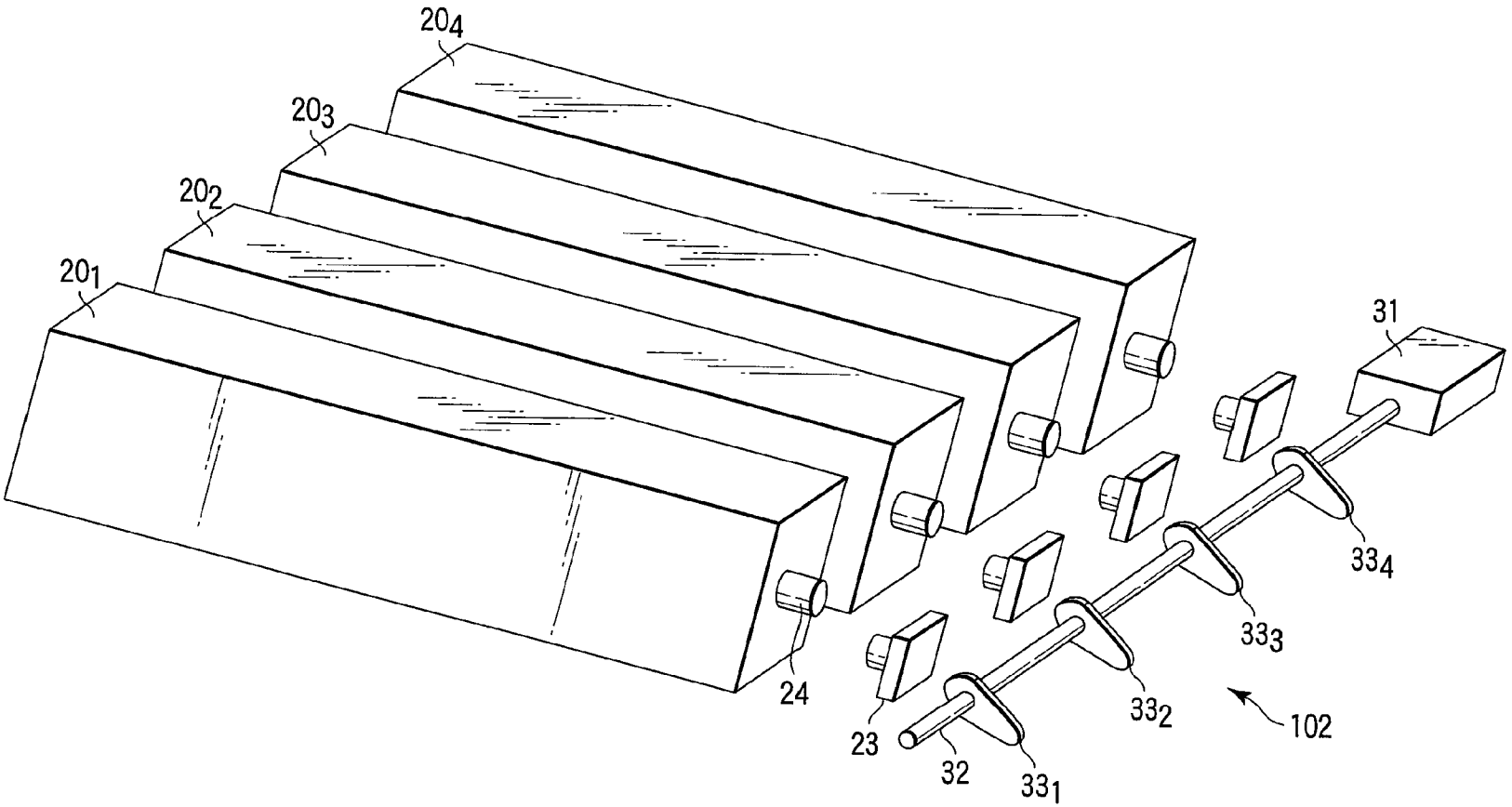
FIG. 3 is a perspective view showing a configuration of a drive unit according to a first embodiment of the invention.

As shown in FIG. 3, the drive unit 102 comprises a motor 31 as a single drive source, drive shaft 32, and cams 33 ($\mathbf{33}_1$, $\mathbf{33}_2$, $\mathbf{33}_3$, $\mathbf{33}_4$) as many as the ink cartridges 20 ($\mathbf{20}_1$ to $\mathbf{20}_4$ in this case). The drive shaft 32 is located parallel to the direction of arrangement of the cartridges $\mathbf{20}_1$ to $\mathbf{20}_4$. Further, an end of the drive shaft 32 is coupled to the motor 31.

FIG. 3 shows the second and first joint portions 23 and 24 in brief. These joint portions will be described in detail below.

The drive shaft 32 is rotated in one direction by the motor 31. Thereupon, the cams $\mathbf{33}_1$ to $\mathbf{33}_4$ rotate in a predetermined direction. Then, the second and first joint portions 23 and 24 are shifted from a separated state shown in FIG. 2B to a connected state shown in FIG. 1B.

In the present embodiment, the second joint portion 23 is moved toward the first joint portion 24 when the cams $\mathbf{33}_1$ to $\mathbf{33}_4$ are brought into contact with the second joint portion 23. As a result, the second joint portion 23 is connected to the first joint portion 24.

Detailed configurations of the joint portion 25, which comprises the second joint portion 23 and the first joint portion 24, will now be described with reference to FIGS. 4 to 6.

The holder portion 21 is provided with a pair of locking members 50*a* and 50*b* for fixedly positioning the mounted ink cartridge 20 relative to the holder portion 21. The locking members 50*a* and 50*b* are arranged so as to hold the ink cartridge 20 from above and below as illustrated.

The locking members 50*a* and 50*b* are formed of leaf springs, e.g., torsion springs, which are held so as to be pivotable around pivots 46*a* and 46*b*. First locking portions 51*a* and 51*b* are disposed on the respective one end portions of the locking members 50*a* and 50*b*, and second locking portions 52*a* and 52*b* on the respective other end portions of the locking members 50*a* and 50*b*.

The locking members 50*a* and 50*b* are continually urged so as to reduce the space between the first locking portions 51*a* and 51*b* and are in contact with first stopper portions 44*a* and 44*b*, respectively, of a stopper member 43. The first locking portions 51*a* and 51*b* are configured to engage with the ink cartridge 20 or engagement portions 56*a* and 56*b* formed on the first joint portion 24 when the cartridge 20 is mounted on the holder portion 21.

As the ink cartridge 20 is mounted on the holder portion 21 (or moved from left to right in FIG. 4), the first locking portions 51*a* and 51*b* first contact slopes of the engagement portions 56*a* and 56*b*, respectively.

If the ink cartridge 20 is further pushed in onto the holder portion 21, the first locking portions 51*a* and 51*b* move along the slopes of the engagement portions 56*a* and 56*b*, respectively. Thereupon, the locking members 50*a* and 50*b* are spread outward against an urging force by the slopes. When this is done, the locking members 50*a* and 50*b* rotate around the pivots 46*a* and 46*b*, respectively, whereupon they are disengaged from the first stopper portions 44*a* and 44*b*, respectively. Then, the locking members 50*a* and 50*b* rotate for a predetermined angle and contact second stopper portions 45*a* and 45*b*, respectively, whereupon their positions are regulated.

If the ink cartridge 20 is finally pushed into a position where its front face contacts an abutting portion 41 of the holder portion 21, the first locking portions 51*a* and 51*b* move beyond the slopes of the engagement portions 56*a* and 56*b* and engage with the engagement portions 56*a* and 56*b*, respectively.

In this state, as mentioned before, the locking members 50*a* and 50*b* are continually urged so as to reduce the space between the first locking portions 51*a* and 51*b*, so that a force is produced to draw in the ink cartridge 20 in a connecting direction. Thus, the ink cartridge 20 is positioned and held in contact with the abutting portion 41 of the holder portion 21. This position is the predetermined position of the ink cartridge 20. In this predetermined position, the read portion 104 is opposed to the storage portion 103 attached to the ink cartridge 20 in order to read the storage portion 103. The read portion 104 reads information on the ink stored in the storage portion 103 and, based on the read information, determines whether or not the second and first joint portions 23 and 24 can be connected to each other without a problem.

Figure 5:
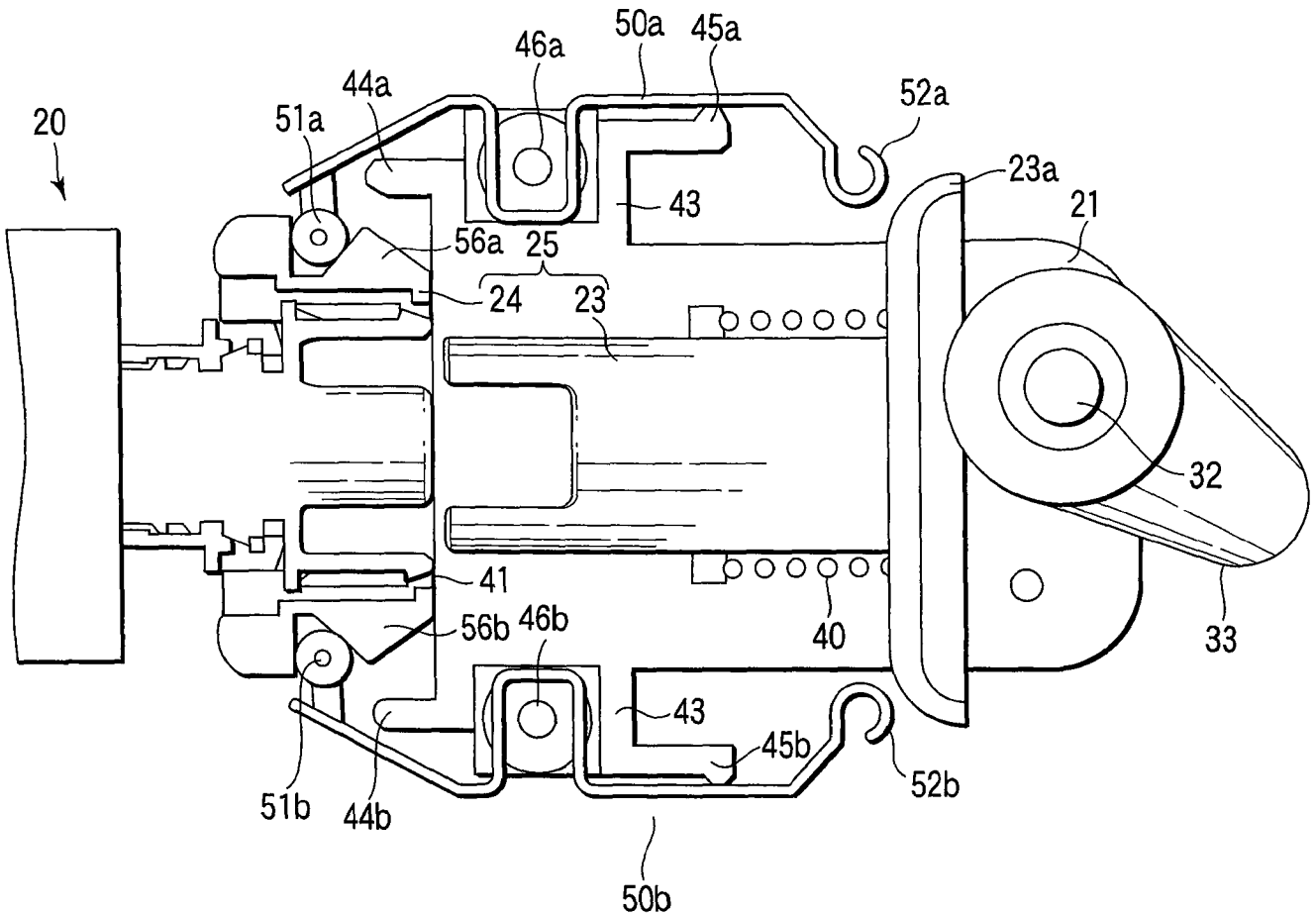
FIG. 5 is a view showing a detailed configuration of the first joint portion and the second joint portion according to the invention.

In the state shown in FIG. 5, the second and first joint portions 23 and 24 are not connected to each other, so that the ink in the ink cartridge 20 cannot be supplied to the recording unit 12.

Figure 6:
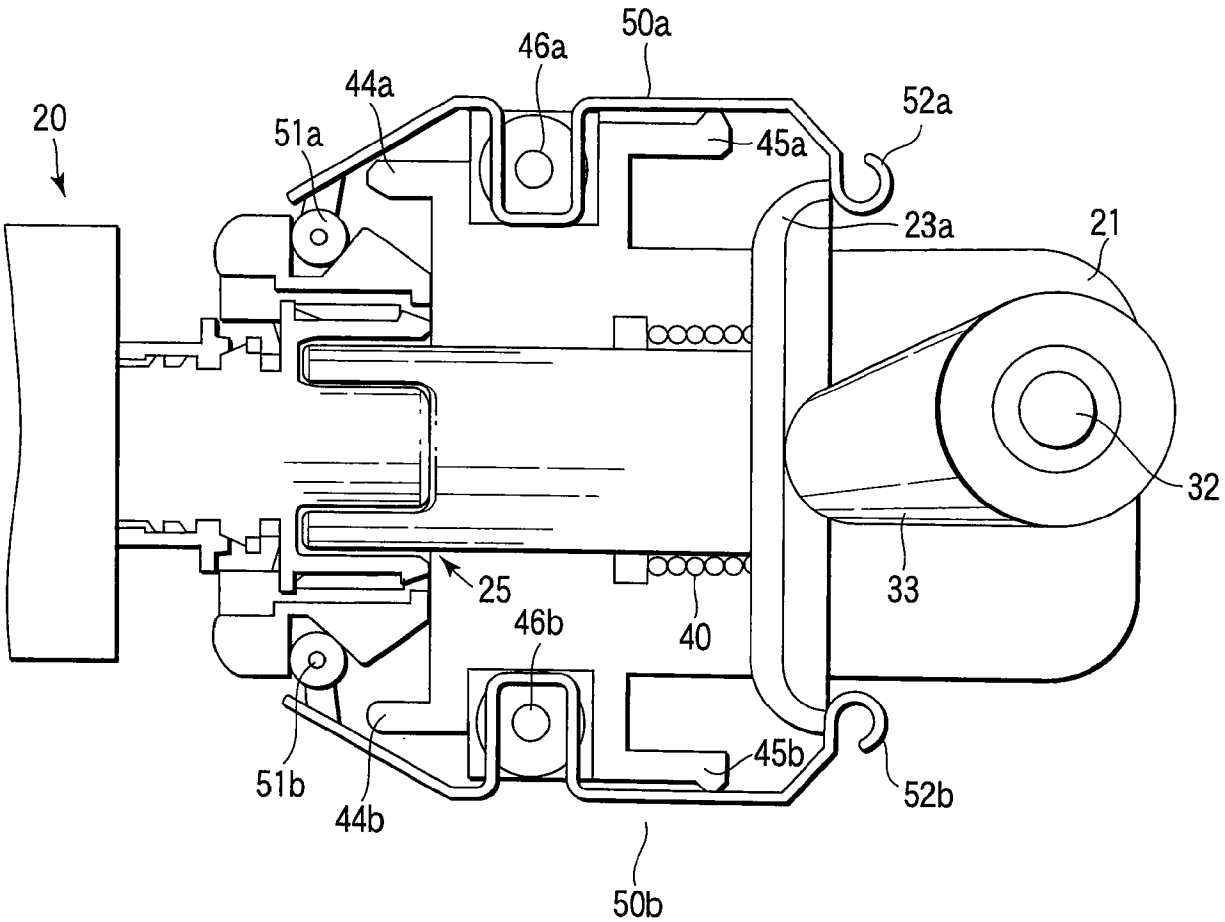
FIG. 6 is a view showing a detailed configuration of the first joint portion and the second joint portion according to the invention.

If no problem is detected by the read portion 104, therefore, the second joint portion 23 is moved so that the state of FIG. 5 is changed into the state of FIG. 6.

The second joint portion 23 is held on the holder portion 21 so as to be movable relative to the first joint portion 24 between a connected position shown in FIG. 6 and a separated position shown in FIG. 5. The second joint portion 23 is provided with a flange portion 23*a* on the side opposite from the side where it is connected to the first joint portion 24. The flange portion 23*a* is configured to engage with the respective second locking portions 52*a* and 52*b* of the locking members 50*a* and 50*b*.

When the ink cartridge 20 is held in the predetermined position, the first locking portions 51*a* and 51*b* on the one end side of the locking members 50*a* and 50*b* are in engagement with the ink cartridge 20. On the other hand, the second locking portions 52*a* and 52*b* on the other end side of the locking members 50*a* and 50*b* are restricted in position by the second stopper portions 45*a* and 45*b*, respectively. If the second joint portion 23 moves from the separated position to the connected position, rounded parts of the second locking portions 52*a* and 52*b* contact the flange portion 23*a*. Thereupon, the flange portion 23*a* gets over the respective tips of the second locking portions 52*a* and 52*b* and is locked in position, as shown in FIG. 6.

Further, the holder portion 21 is provided with a return spring 40. The return spring 40 continually urges the second joint portion 23 in a separating direction. If the second locking portions 52*a* and 52*b* are disengaged from the flange portion 23*a*, the return spring 40 moves the second joint portion 23 to the separated position.

The drive unit 102 for use as a common drive mechanism for all the cartridges is located behind the separated position of the second joint portion 23. The drive unit 102 serves to connect the second and first joint portions 23 and 24. Specifically, as mentioned before, the drive unit 102 comprises the drive shaft 32 located parallel to the direction of arrangement of the ink cartridges, cams $\mathbf{33}_1$ to $\mathbf{33}_4$ disposed on the shaft 32 so as to correspond individually to the ink cartridges, and motor 31 as a single drive source on the end of the shaft 32 (see FIG. 3).

The drive shaft 32 is rotated in one direction by the motor 31. The cams 33 are fixed to the drive shaft 32. If the drive shaft 32 is rotated in this manner, the tip portion of each cam 33 contacts the flange portion 23*a* of the second joint portion 23 in the separated position. This contact is maintained as the cam 33 rotates. Thus, the second joint portion 23 can be moved from the separated position to the connected position.

In disconnecting the second and first joint portions 23 and 24, the ink cartridge 20 is first drawn out so as to be disengaged from the locking members 50*a* and 50*b*. Thereupon, the locking members 50*a* and 50*b* rotate around the pivots 46*a* and 46*b*, respectively, to be released from contact with the second stopper portions 45*a* and 45*b* and contact the first stopper portions 44*a* and 44*b*. Specifically, the second locking portions 52*a* and 52*b* are also disengaged from the flange portion 23*a*. Thus, the second joint portion 23 is moved from the connected position to the separated position by the return spring 40.

An operation for connecting the ink cartridge according to the first embodiment will now be described with reference to the flowchart of FIG. 7.

First, in Step S1, it is determined whether or not the cover 21*c* is opened. The interlock is ON when the cover 21*c* is opened so that the interlocking portion 105 is activated. The interlock is OFF when the cover 21*c* is closed so that the interlocking portion 105 is inactivated. If the cover 21*c* is determined to be open, the interlocking portion 105 is activated (Yes), and drive parts in the apparatus are automatically stopped in Step S2. If the cover 21*c* is not determined to be open (No) in Step S1, its opening is awaited.

In this state, the ink cartridge 20 is mounted on the holder portion 21 by the user. Specifically, as shown in FIG. 4, the distal end portion of the cartridge 20 contacts the respective first locking portions 51*a* and 51*b* and elastically deforms the locking portions to spread them as the cartridge 20 is inserted.

Thus, the first locking portions 51*a* and 51*b* engage with the engagement portions 56*a* and 56*b*, respectively, and the distal end portion of the ink cartridge 20 contacts the abutting portion 41 of the holder portion 21, as shown in FIG. 5. In this state, the locking members 50*a* and 50*b* produce a force to press the ink cartridge 20 against the abutting portion 41 of the holder portion 21, so that the cartridge 20 can be held in the predetermined position.

In mounting a plurality of ink cartridges 20, the cartridges are inserted into the predetermined position.

When all the inserted ink cartridges are thus held in the predetermined position, the cover 21*c* is closed (interlock OFF) in Step S3 (Yes). If the cover 21*c* is not closed (No), its closing is awaited.

Then, in Step S4, it is determined whether or not the storage portions 103 attached individually to the ink cartridges 20 are read by all the read portions 104 on the holder portion 21. In other words, it is determined whether or not ink information is received by all the read portions 104. Since the four ink cartridges $\mathbf{20}_1$ to $\mathbf{20}_4$ are used in the present embodiment, it is determined whether or not the ink information is received by all the read portions 104 corresponding to the four ink cartridges. If the ink information is received by all the read portions 104 (Yes), the program proceeds to Step S5. If not (No), the program proceeds to Step S9.

In Step S5, it is determined whether or not the ink information read by the read portions 104 is adaptive to the printer. The ink information contains at least one of data including a trade name, serial number, color, type, life, etc. If any of the ink cartridges held in the predetermined position is determined to be non-adaptive in Step S5 (No), the program proceeds to Step S9.

In Step S9, the motor 31 is not driven, so that the second joint portion 23 is kept in the separated position. If it is determined in Step S4 that the ink information is not received by all the read portions 104, the user is notified of it through display on a control panel (not shown) in Step S9. If any piece of the ink information is determined to be inappropriate in Step S5, the non-adaptive ink cartridge is displayed on the control panel for the user information in Step S9.

If all the ink cartridges are determined to be adaptive (Yes) in Step S5, on the other hand, the program proceeds to Step S6, where the motor 31 is driven to rotate the drive shaft 32.

Then, in Step S7, it is determined whether or not the ink cartridge 20 and the main body of the apparatus are connected. In other words, it is determined whether or not the second and first joint portions 23 and 24 are connected. In the present embodiment, the joint portions 23 and 24 are connected if the cams 33 make one revolution. Thus, in Step S7, the motor 31 continues to be driven so that the cams 33 make one revolution. When one revolution is made by the cams 33, the program proceeds to Step S8, where the drive of the motor 31 is stopped.

In Step S7, all the second joint portions 23 are moved to the connected position (shown in FIG. 6) by the cams 33. The return spring 40 is compressed when this is done. Further, this movement causes the respective second locking portions 52*a* and 52*b* to be elastically deformed and spread individually by end portions of the flange portion 23*a*. Thereupon, the flange portion 23*a* engages with the second locking portions 52*a* and 52*b*. After one revolution is made by each cam 33, each second joint portion 23 is urged to move toward the separated position by the elastic force of the return spring 40. Since the flange portion 23*a* is in engagement with the second locking portions 52*a* and 52*b*, however, the connection between the second and first joint portions 23 and 24 is maintained (see FIG. 6).

The following advantages can be obtained by this arrangement.

If the ink cartridge 20 is drawn out by the user, the first locking portions 51*a* and 51*b* move along the slopes of the engagement portions 56*a* and 56*b*, respectively, and are spread by elastic deformation. If the ink cartridge 20 is removed so that the first locking portions 51*a* and 51*b* are disengaged from the engagement portions 56*a* and 56*b*, the spread first locking portions 51*a* and 51*b* return to their respective original positions. Specifically, the locking members 50*a* and 50*b* pivot and stop when they contact the first stopper portions 44*a* and 44*b*, respectively. By this pivotal displacement, the second locking portions 52*a* and 52*b* having so far been locking the flange portion 23*a* of the second joint portion 23 are retreated to an unlocking position.

The second joint portion 23 released from the restriction is moved to the separated position by the elastic force of the compressed return spring 40 and stops there. Thus, if the ink cartridge 20 is removed, the second joint portion 23 never fails to be retreated to the separated position without regard to the state (ON or OFF) of the energy source of the apparatus. Therefore, the joint portions of a non-adaptive ink cartridge cannot be brought into contact with an ink path in the apparatus, irrespective of the situation in which the cartridge 20 is mounted. Consequently, color mixture, print quality degradation, and other failures can be securely prevented.

Further, connecting operation is performed by the motor as a single drive source only in the case where all the ink cartridges used are adaptive. It is unnecessary, therefore, to provide drive mechanisms as many as the ink cartridges used. Thus, the apparatus can be reduced in size and cost.

(Modification)

The following is a description of a modification of the first embodiment of the invention.

According to the first embodiment described above, ink information for the four cartridges is collectively read in a single operation starting at the point in time when the cover is closed (interlock OFF). In this modification, on the other hand, whether or not each ink cartridge is adaptive is determined every time the cartridge is mounted in the predetermined position.

Figure 8:
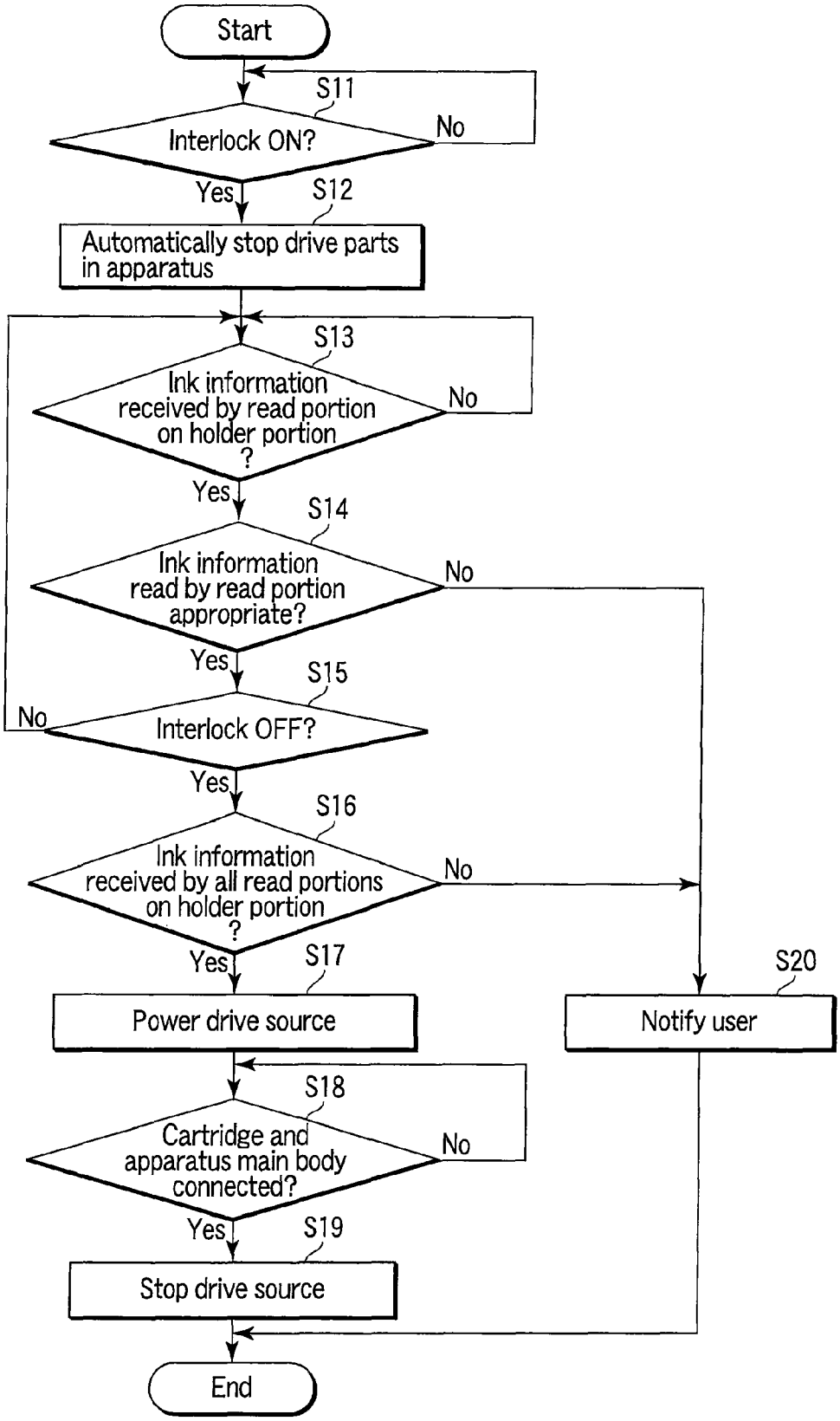
FIG. 8 is a flowchart for illustrating an ink cartridge connecting operation according to a modification of the first embodiment of the invention.

FIG. 8 is a flowchart for illustrating an ink cartridge connecting operation according to the modification of the first embodiment of the invention.

Figure 7:
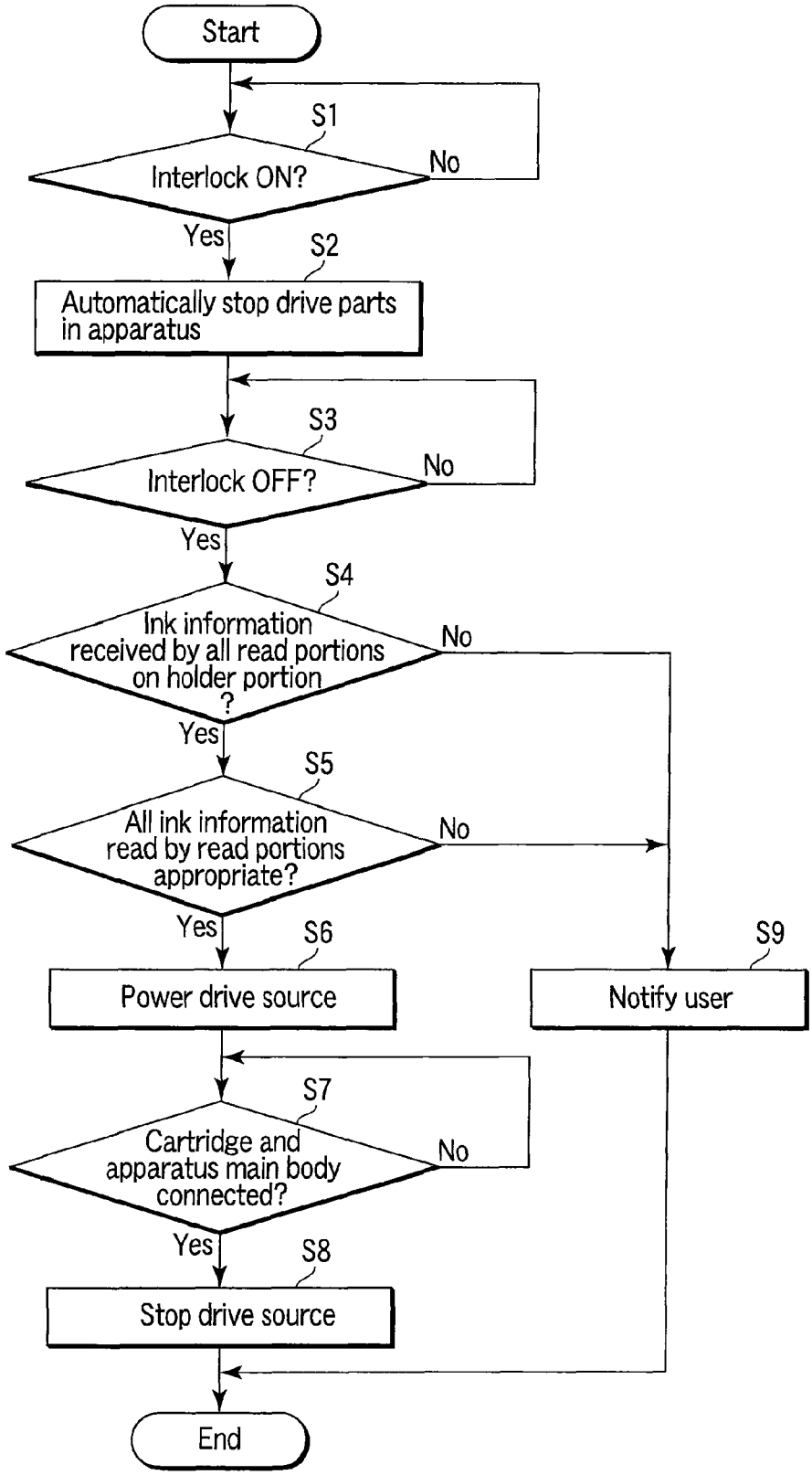
FIG. 7 is a flowchart for illustrating an ink cartridge connecting operation according to the first embodiment of the invention.

In this flowchart, the processing of Steps S11, S12, and S17 to S20 is identical with the processing of Steps S1, S2, and S6 to S9 in the foregoing flowchart of FIG. 7. Therefore, a detailed description of steps of corresponding numbers is omitted, and only different steps will now be described in detail.

In Step S11, it is determined whether or not the cover 21*c* is opened. If the cover 21*c* is determined to be open (Yes), drive parts in the apparatus are automatically stopped in Step S12. Subsequently, in Step S13, it is determined whether or not ink information from the storage portion 103 is received by the read portion 104 on the holder portion 21. If the ink information is then determined to be received (Yes), the program proceeds to Step S14. In Step S14, it is determined whether or not the ink information read by the read portion 104 is appropriate.

If the ink information is determined to be inappropriate (No), the program proceeds to Step S20, where a massage to the effect that the ink cartridge is non-adaptive is displayed on the control panel. If the ink information is determined to be appropriate (Yes), on the other hand, the program proceeds to Step S15, where the state of the cover 21*c* is determined. If the cover 21*c* is not determined to be closed (No), the program proceeds to Step S13, where the aforementioned processing is performed. If the cover 21*c* is determined to be closed (Yes), on the other hand, the program proceeds to Step S16. In Step S16, it is determined whether or not the ink information is received by all the read portions 104 on the holder portion 21. Since subsequent processing is identical with that in the aforementioned flowchart of FIG. 7, a description thereof is omitted.

Also with this arrangement, it is unnecessary to provide drive mechanisms as many as the ink cartridges used. Thus, the apparatus can be reduced in size and cost.

Second Embodiment

In the first embodiment described above, whether or not the cartridges are mounted in the predetermined position is determined by the read portions 104 on the holder portion. In a second embodiment, on the other hand, a holder portion is provided with a dedicated sensor for each ink cartridge that is used to determine whether or not the cartridge is mounted in the predetermined position.

In the second embodiment to be described below, the configuration and basic operation of an inkjet printer are the same as those of the inkjet printer of the first embodiment shown in FIGS. 1A to 7. In connection with the configuration and operation, therefore, like portions are designated by like reference numbers and their illustration and description are omitted, and only different operations will be described below.

Figure 4:
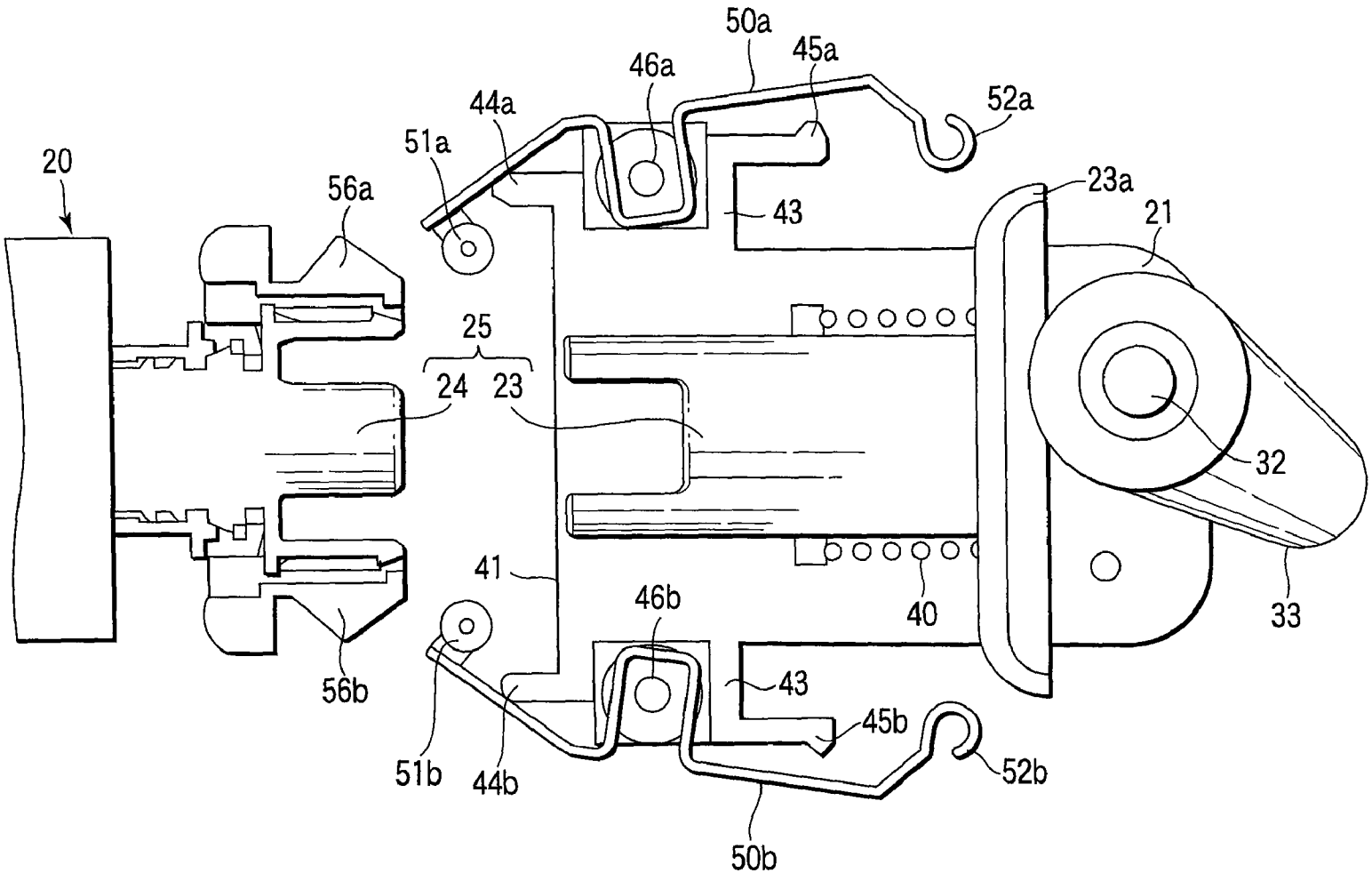
FIG. 4 is a view showing a detailed configuration of the first joint portion and the second joint portion according to the invention.

In FIGS. 4 to 6, a sensor (not shown) for determining whether or not the ink cartridge 20 is mounted in the predetermined position is disposed near the first stopper portions 44*a* and 44*b* of the holder portion 21. This sensor makes this determination by detecting, for example, the respective positions of the locking members 50*a* and 50*b*.

Figure 9:
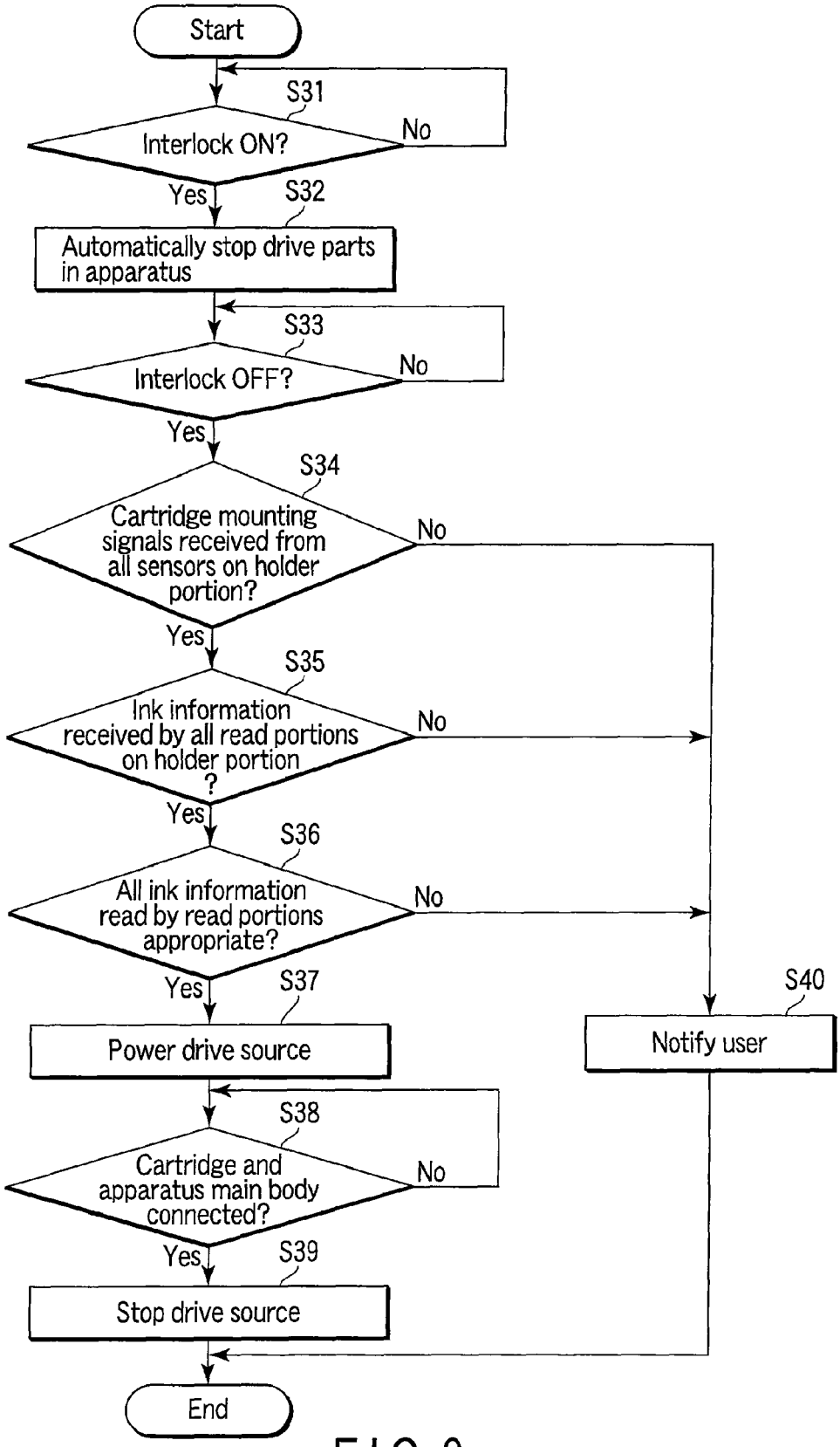
FIG. 9 is a flowchart for illustrating an ink cartridge connecting operation according to a second embodiment of the invention.

FIG. 9 is a flowchart for illustrating an ink cartridge connecting operation according to the second embodiment of the invention.

In this flowchart, the processing of Steps S31 to S33 and S37 to S40 is identical with the processing of Steps S1 to S3 and S6 to S9 in the foregoing flowchart of FIG. 7. Therefore, a description of steps of corresponding numbers is omitted, and only different steps will now be described.

If the cover 21*c* is determined to be closed (Yes) in Step S33, the program proceeds to Step S34. In Step S34, it is determined whether or not mounting signals for the ink cartridges 20 are received from all the sensors on the holder portion 21. If the mounting signals are determined to be received from all the sensors (Yes), the program proceeds to Step S35. If there is any sensor from which no mounting signal is determined to be received (No), however, the program proceeds to Step S40. In Step S40, an error is displayed on the control panel.

In Step S35, it is determined whether or not the ink information is received by all the read portions 104 having read the storage portions 103 attached to the ink cartridges. If all the information is determined to be received (Yes), the program proceeds to Step S36. If not (No), the program proceeds to Step S40.

In Step S36, it is determined whether or not all the ink information read by the read portions 104 is appropriate. If all the ink information is determined to be appropriate (Yes), the program proceeds to Step S37. If any piece of the ink information is determined to be inappropriate (No), the program proceeds to Step S40. Since subsequent processing is identical with that in the aforementioned flowchart of FIG. 7, a description thereof is omitted.

Also with this arrangement, it is unnecessary to provide drive mechanisms as many as the ink cartridges used. Thus, the apparatus can be reduced in size and cost.

(Modification)

The following is a description of a modification of the second embodiment of the invention.

According to the second embodiment described above, ink information for the four cartridges is collectively read in a single operation starting at the point in time when the cover is closed (interlock OFF). In this modification, on the other hand, whether or not each ink cartridge is adaptive is determined every time the cartridge is mounted in the predetermined position.

Figure 10:
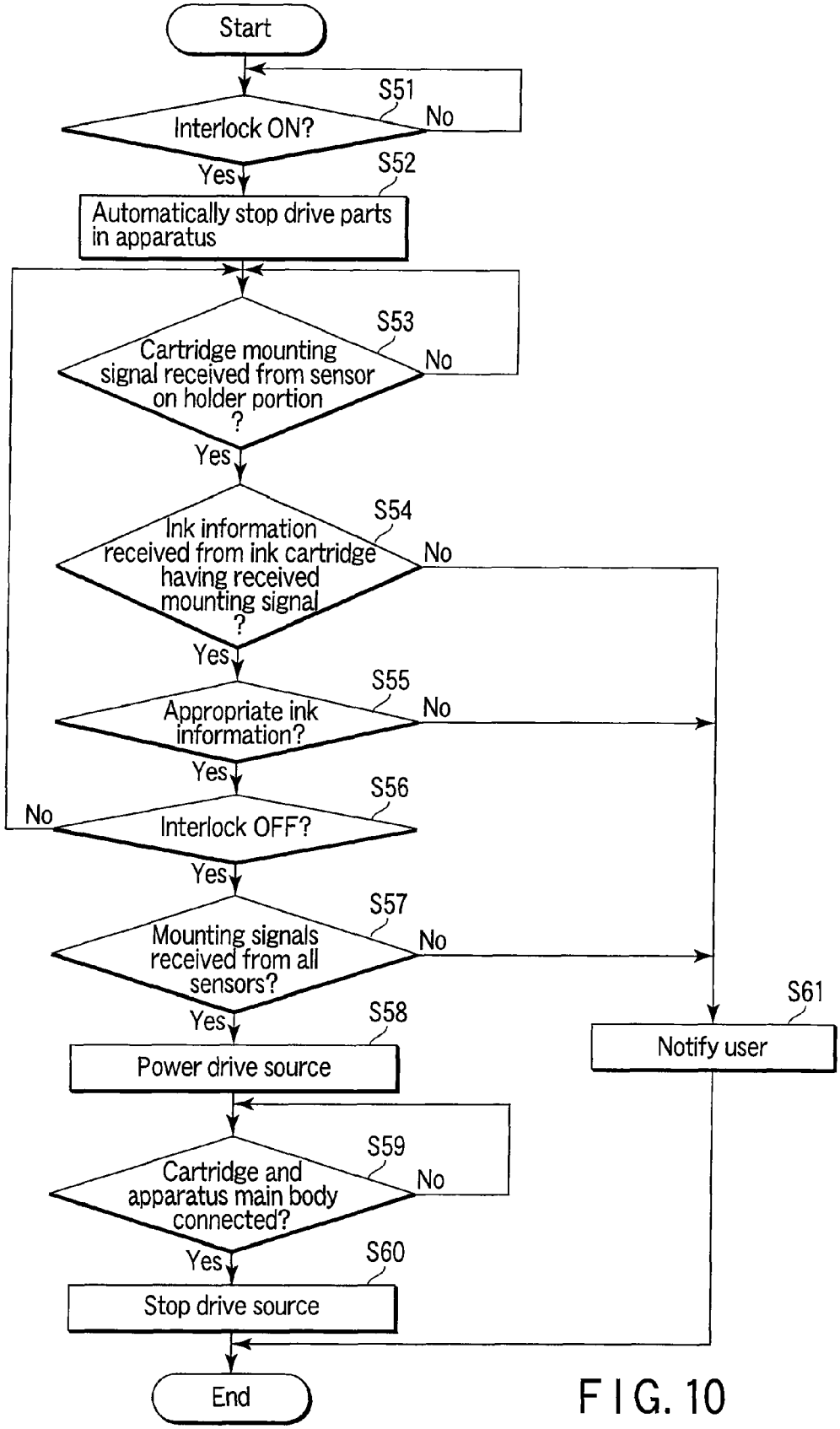
FIG. 10 is a flowchart for illustrating an ink cartridge connecting operation according to a modification of the second embodiment of the invention.

FIG. 10 is a flowchart for illustrating an ink cartridge connecting operation according to the modification of the second embodiment of the invention.

In this flowchart, the processing of Steps S51, S52, and S58 to S61 is identical with the processing of Steps S31, S32, and S37 to S40 in the foregoing flowchart of FIG. 9. Therefore, a detailed description of steps of corresponding numbers is omitted, and only different steps will now be described in detail.

If the cover 21*c* is determined to be opened in Step S51, the interlocking portion 105 is activated (Yes), and drive parts in the apparatus are automatically stopped in Step S52. Then, in Step S53, it is determined whether or not a mounting signal for the ink cartridge 20 is received from the sensor on the holder portion 21. If the mounting signal is determined to be received (Yes) in Step S53, it is then determined in Step S54 whether or not ink information is received from the ink cartridge 20 mounted in the position where the mounting signal is received. Specifically, it is determined whether or not the storage portion 103 attached to the ink cartridge 20 is read by the read portion 104. If no mounting signal is determined to be received (No) in Step S53, the ink cartridge mounting is awaited.

If the ink information is determined to be received (Yes) in Step S54, the program proceeds to Step S55. If not (No), the program proceeds to Step S61. In Step S55, it is determined whether or not the received ink information is appropriate. If the ink information is not determined to be appropriate (No), the program proceeds to Step S61. If the ink information is determined to be appropriate (Yes), on the other hand, the program proceeds to Step S56, where the interlock state is determined.

If the cover 21*c* is not determined in Step S56 to be closed (No), the program proceeds to Step S53, where the aforementioned processing is performed. If the cover 21*c* is determined to be closed (Yes), on the other hand, the program proceeds to Step S57. In Step S57, it is determined whether or not mounting signals for the ink cartridges are received from all the sensors. If all the mounting signals are determined to be received (Yes), the program proceeds to Step S58. If any of the mounting signals is not determined to be received (No), the program proceeds to Step S61.

In Step S61, an error is displayed on the control panel.

Since the processing of Step S58 and subsequent processing are identical with those in the aforementioned flowchart of FIG. 7, a description thereof is omitted.

Also with this arrangement, it is unnecessary to provide drive mechanisms as many as the ink cartridges used. Thus, the apparatus can be reduced in size and cost.

Third Embodiment

The following is a description of a third embodiment of the invention.

If the holder portion is configured to mount a plurality of (e.g., four) ink cartridges thereon, according to the first and second embodiments described above, the drive source cannot be powered unless the apparatus is loaded with all the four ink cartridges. According to the third embodiment, on the other hand, the drive source can be powered without regard to the number of ink cartridges only if an adaptive cartridge or cartridges are mounted.

In the third embodiment to be described below, the configuration and basic operation of an inkjet printer are the same as those of the inkjet printer of the first embodiment shown in FIGS. 1A to 7. In connection with the configuration and operation, therefore, like portions are designated by like reference numbers and their illustration and description are omitted, and only different operations will be described below. In the present embodiment, as in the second embodiment, the holder portion is provided with a dedicated sensor (not shown) for each ink cartridge that is used to determine whether or not the cartridge is mounted in the predetermined position.

Figure 11:
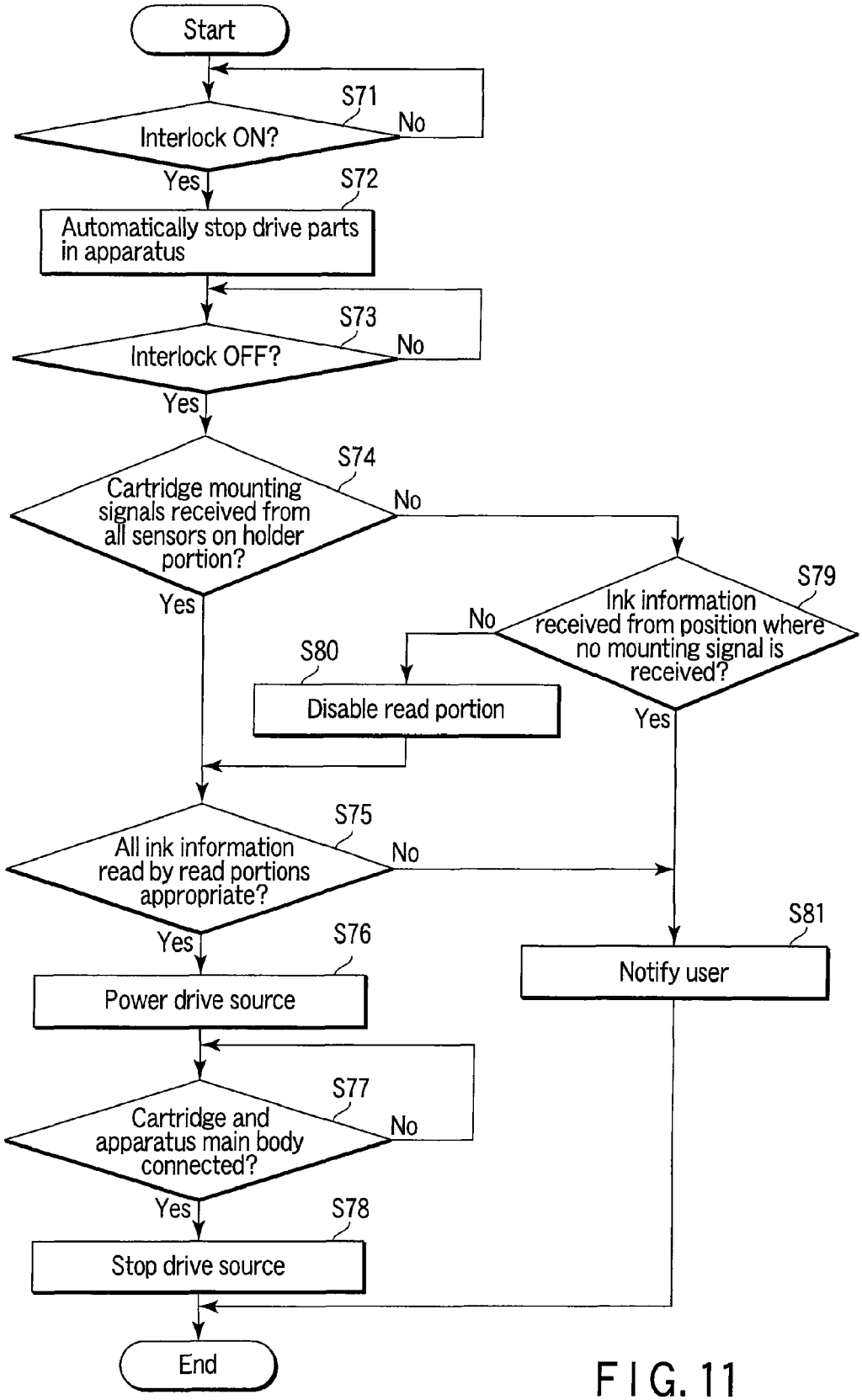
FIG. 11 is a flowchart for illustrating an ink cartridge connecting operation according to a third embodiment of the invention.

FIG. 11 is a flowchart for illustrating an ink cartridge connecting operation according to the third embodiment of the invention.

In this flowchart, the processing of Steps S71 to S73, S76 to S78, and S81 is identical with the processing of Steps S1 to S3 and S6 to S9 in the foregoing flowchart of FIG. 7. Therefore, a description of steps of corresponding numbers is omitted, and only different steps will now be described.

If the cover 21*c* is determined to be closed (Yes) in Step S73, it is determined in Step S34 whether or not mounting signals for the ink cartridges 20 are received from all the sensors on the holder portion 21. If the mounting signals are determined to be received from all the sensors (Yes), the program proceeds to Step S75. If there is any sensor from which no mounting signal is determined to be received (No), however, the program proceeds to Step S79. In Step S79, it is determined whether or not the ink information is received from a position where no mounting signal is received. In other words, it is determined whether or not the ink information is received by the read portion 104 corresponding to the position where no mounting signal is received.

If the ink information is determined to be received (Yes), the sensor and/or read portion 104 is in trouble, whereupon the program proceeds to Step S81. If not (No), the program proceeds to Step S80.

In Step S80, the read portion on the holder portion is disabled. Specifically, it is determined in Step S80 that the ink cartridge 20 is not intentionally mounted on the holder portion 21 by the user. Then, a signal from the read portion in the position where no mounting signal is received is disabled, whereupon the program proceeds to Step S75. Thus, if there is a read portion disabled in Step S80, it is determined in Step S75 whether or not all the ink information read by read portions other than the disabled one is appropriate.

If all the information is determined to be appropriate (Yes), the program proceeds to Step S76. If any piece of the ink information is determined to be inappropriate (No), the program proceeds to Step S81.

Since subsequent processing is identical with that in the aforementioned flowchart of FIG. 7, a description thereof is omitted.

Also with this arrangement, it is unnecessary to provide drive mechanisms as many as the ink cartridges used. Thus, the apparatus can be reduced in size and cost.

(Modification)

The following is a description of a modification of the third embodiment of the invention.

According to the third embodiment described above, ink information for the four cartridges is collectively read in a single operation starting at the point in time when the cover is closed (interlock OFF). In this modification, on the other hand, whether or not each ink cartridge is adaptive is determined every time the cartridge is mounted in the predetermined position.

Figure 12:
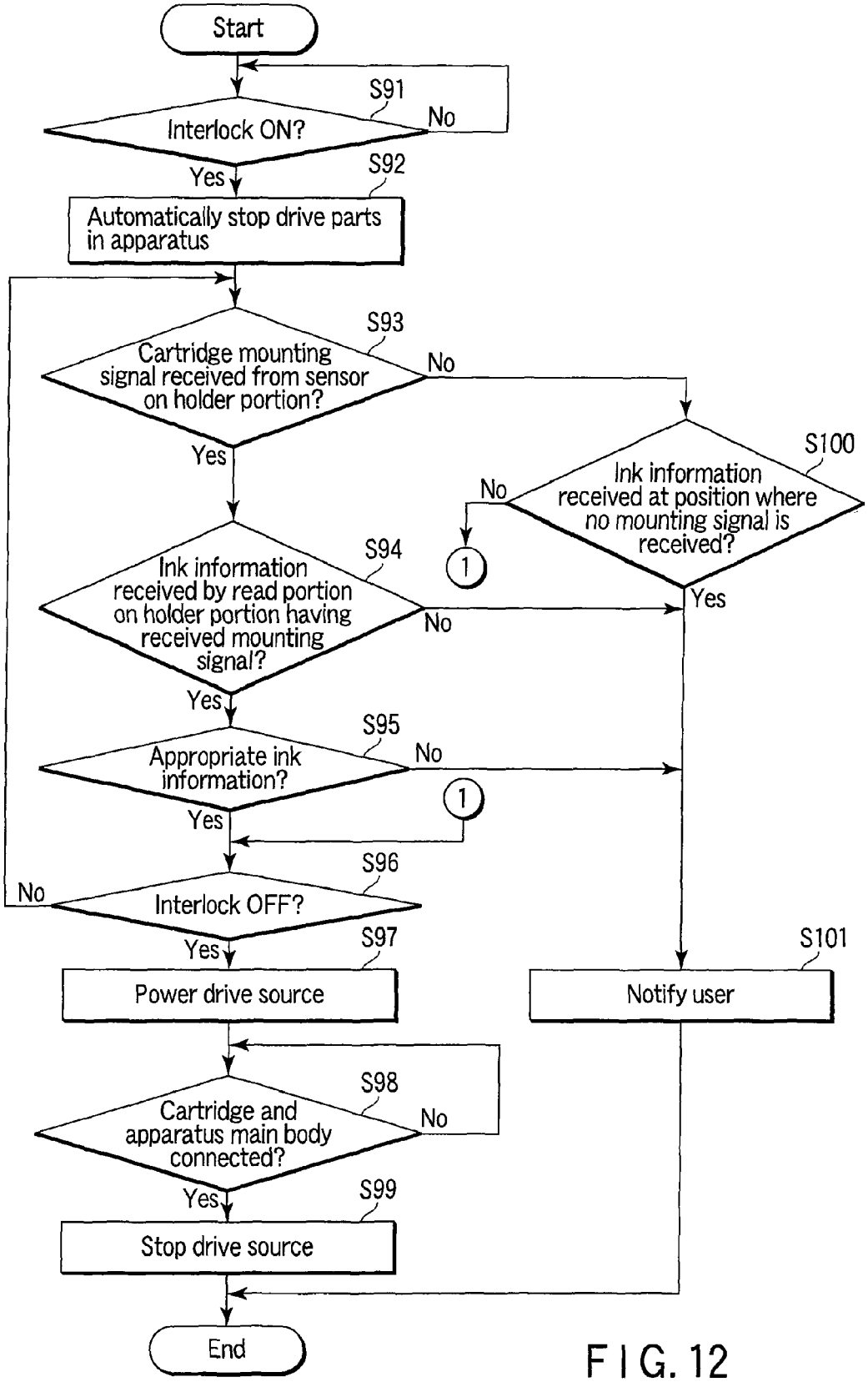
FIG. 12 is a flowchart for illustrating an ink cartridge connecting operation according to a modification of the third embodiment of the invention.

FIG. 12 is a flowchart for illustrating an ink cartridge connecting operation according to the modification of the third embodiment of the invention.

In this flowchart, the processing of Steps S91, S92, and S97 to S99, and S101 is identical with the processing of Steps S71, S72, S76 to S78, and S81 in the foregoing flowchart of FIG. 11. Therefore, a detailed description of steps of corresponding numbers is omitted, and only different steps will now be described in detail.

If the cover 21*c* is determined to be opened in Step S91, the interlocking portion 105 is activated (Yes), and drive parts in the apparatus are automatically stopped in Step S92. Then, in Step S93, it is determined whether or not a mounting signal for the ink cartridge 20 is received from a sensor on the holder portion 21. If the mounting signal is determined to be received (Yes), it is then determined in Step S94 whether or not ink information for the ink cartridge 20 is received from the read portion 104 on the holder portion 21 having received the mounting signal.

If the ink information is then determined to be received (Yes), the program proceeds to Step S95. If not (No), the program proceeds to Step S101. In Step S95, it is determined whether or not the received ink information is appropriate. If the ink information is not determined to be appropriate (No), the program proceeds to Step S101. If the ink information is determined to be appropriate (Yes), on the other hand, the program proceeds to Step S96, where the interlock state is determined.

If the cover 21*c* is not determined in Step S96 to be closed (No), the program proceeds to Step S93, where the aforementioned processing is performed. If the cover 21*c* is determined to be closed (Yes), on the other hand, the program proceeds to Step S97.

If the mounting signal is not determined to be received (No) in Step S93, moreover, the program proceeds to Step S100, where it is determined whether or not the ink information is received at a position where no mounting signal is received. If the ink information is then determined to be received (Yes), the program proceeds to Step S101. If not (No), the program proceeds to Step S96.

Also with this arrangement, it is unnecessary to provide drive mechanisms as many as the ink cartridges used. Thus, the apparatus can be reduced in size and cost.

Fourth Embodiment

Figure 13:
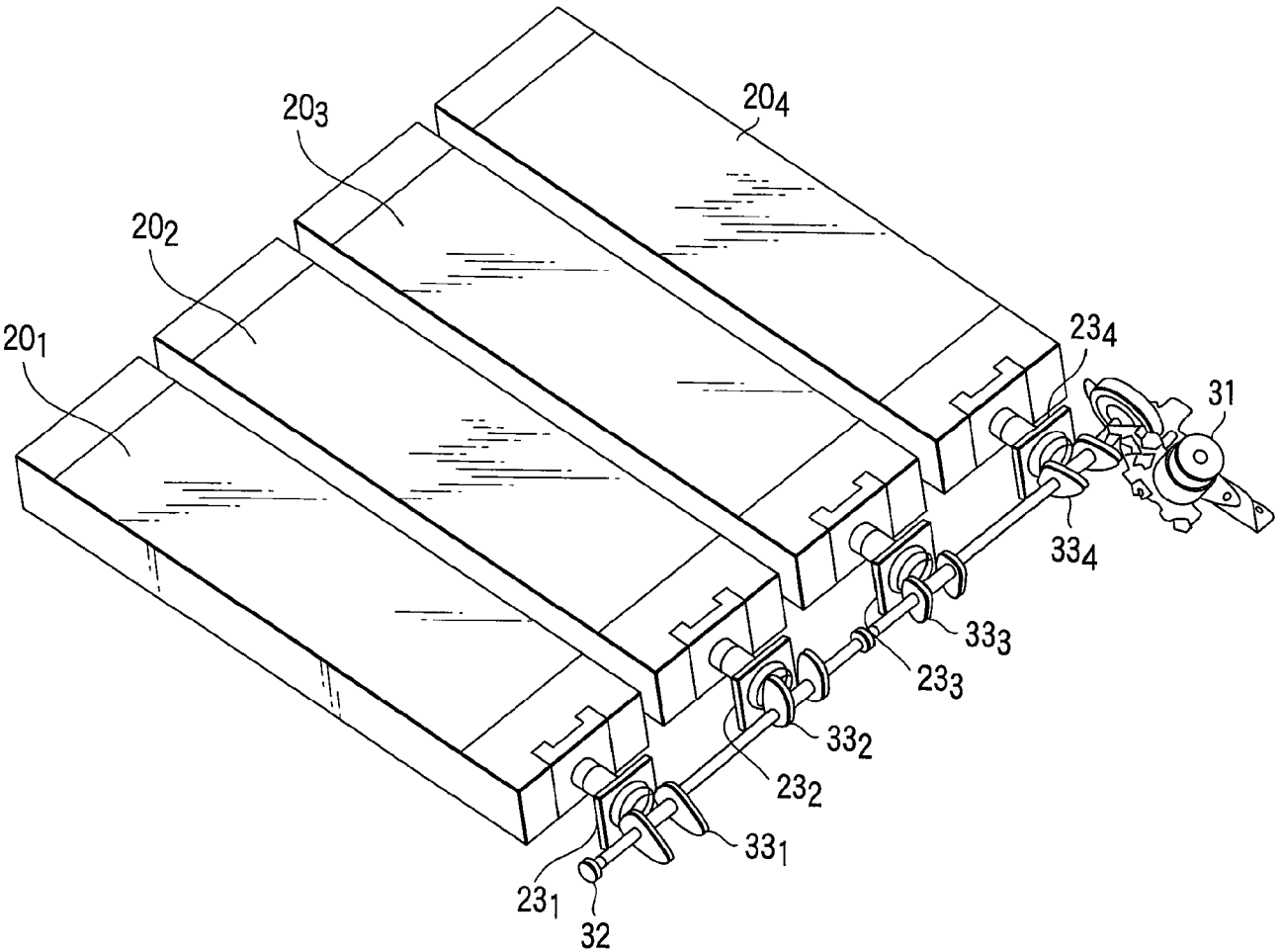
FIG. 13 is a perspective view showing a configuration of a drive unit according to a fourth embodiment of the invention.
Figure 14:
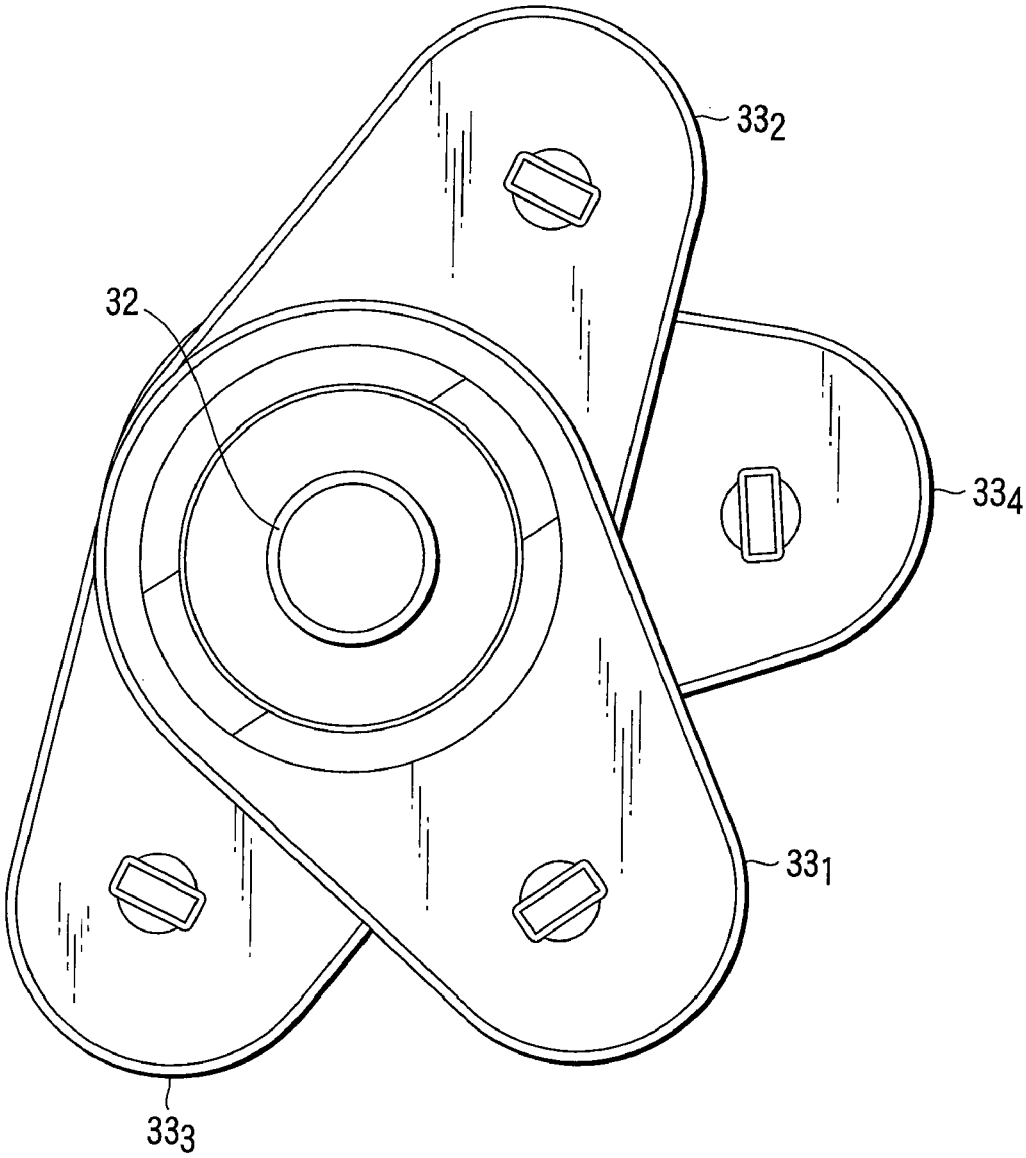
FIG. 14 is a side view showing a configuration of cams according to the fourth embodiment of the invention.

A fourth embodiment of the invention will now be described with reference to FIGS. 13 and 14.

In the fourth embodiment, the respective phases of cams 33 ($\mathbf{33}_1$, $\mathbf{33}_2$, $\mathbf{33}_3$, $\mathbf{33}_4$) relative to a drive shaft 32 are different for individual ink cartridges. In other words, the cams $\mathbf{33}_1$ to $\mathbf{33}_4$ are mounted on the drive shaft 32 at different angles for the individual cartridges. Thus, the fourth embodiment is configured so that second joint portions 23 are not moved to the connected position all at once but one by one.

In the fourth embodiment to be described below, the configuration and basic operation of an inkjet printer are the same as those of the inkjet printer of the first embodiment shown in FIGS. 1A to 7. In connection with the configuration and operation, therefore, like portions are designated by like reference numbers and their illustration and description are omitted, and only different operations will be described below.

In the fourth embodiment, a plurality of ink cartridges 20 ($\mathbf{20}_1$, $\mathbf{20}_2$, $\mathbf{20}_3$, $\mathbf{20}_4$) are provided for inks of different colors. The cams $\mathbf{33}_1$ to $\mathbf{33}_4$ for moving the second joint portions 23 ($\mathbf{23}_1$, $\mathbf{23}_2$, $\mathbf{23}_3$, $\mathbf{23}_4$) are arranged with phase differences for the colors on the same drive shaft 32. With this structure, when the drive shaft 32 rotates, for example, cam $\mathbf{33}_1$ comes into contact with second joint portion $\mathbf{23}_1$, thereby moving second joint portion $\mathbf{23}_1$ to the connected position. Then, cam $\mathbf{33}_2$ comes into contact with second joint portion $\mathbf{23}_2$, thereby moving second joint portion $\mathbf{23}_2$ to the connected position. Subsequently, cam $\mathbf{33}_3$ comes into contact with second joint portion $\mathbf{23}_3$, thereby moving second joint portion $\mathbf{23}_3$ to the connected position. Lastly, cam $\mathbf{33}_4$ comes into contact with second joint portion $\mathbf{23}_4$, thereby moving second joint portion $\mathbf{23}_4$ to the connected position.

Thus, drive unit according to the fourth embodiment are configured to be connected with phase differences for the colors to the ink cartridges, individually. Consequently, a load on a drive source (motor) can be mitigated, so that the apparatus can be further reduced in size and cost.

The arrangement of the cams according to the fourth embodiment is also applicable to any of the first to third embodiments and modifications.

Although preferred embodiments of the present invention have been described herein, it is to be understood that the invention is not limited to those embodiments and that various changes and modifications may be effected therein by one skilled in the art without departing from the scope or spirit of the invention.

Further, the above-described embodiments include inventions in various stages, and various inventions can be extracted by appropriately combining a plurality of constituent elements disclosed in the embodiments.

What is claimed is:

1. An inkjet printer comprising:

a plurality of ink cartridges each comprising an ink containing portion which contains an ink, a first joint portion through which the ink contained in the ink containing portion is caused to flow out, and a storage medium stored with information on the ink contained in the ink containing portion;

a holder portion comprising a holding member which removably holds the ink cartridges in predetermined positions, individually, a plurality of second joint portions spaced from the respective first joint portions of the ink cartridges held in the predetermined positions and disposed corresponding individually to the ink cartridges held by the holding member, and a plurality of read portions which are disposed corresponding individually to the ink cartridges held by the holding member and which read the respective storage media of the ink cartridges held in the predetermined positions;

a drive unit which moves the second joint portions in such a direction that the second joint portions are connected individually to respective first joint portions of the corresponding ink cartridges; and a control unit which controls drive of the drive unit based on information read by the read portions, the control unit being configured to start driving the drive unit after determining that all pieces of the information read individually by the read portions are appropriate.

2. An inkjet printer according to claim 1, wherein the drive unit comprises a motor, a shaft connected to the motor and extending in a direction in which the ink cartridges held by the holding member are arranged, and a plurality of cam members provided on the shaft and arranged at positions corresponding to the second joint portions, the cam members being configured to simultaneously contact the second joint portions, thereby simultaneously moving the second joint portions in the arrangement direction, as the shaft is rotated by the motor.

3. An inkjet printer according to claim 1, wherein the drive unit comprises a motor, a shaft connected to the motor and extending in a direction in which the ink cartridges held by the holding member are arranged, and a plurality of cam members provided on the shaft, and arranged at positions corresponding to the second joint portions and at different angles corresponding to the second joint portions, the cam members being configured to sequentially contact the second joint portions, thereby sequentially moving the second joint portions in the arrangement direction, as the shaft is rotated by the motor.

4. An inkjet printer according to claim 1, wherein the holder portion further comprises a swingable cover which covers the ink cartridges held by the holding member and a cover sensor for detecting whether or not the cover is closed, and the control unit starts driving the drive unit after the closure of the cover is detected by the cover sensor and it is determined that all pieces of the information read individually by the read portions is appropriate.

5. An inkjet printer according to claim 4, wherein the drive unit comprises a motor, a shaft connected to the motor and extending in a direction in which the ink cartridges held by the holding member are arranged, and a plurality of cam members provided on the shaft and arranged at positions corresponding to the second joint portions, the cam members being configured to simultaneously contact the second joint portions, thereby simultaneously moving the second joint portions in the arrangement direction, as the shaft is rotated by the motor.

6. An inkjet printer according to claim 4, wherein the drive unit comprises a motor, a shaft connected to the motor and extending in a direction in which the ink cartridges held by the holding member are arranged, and a plurality of cam members provided on the shaft and arranged at positions corresponding to the second joint portions and at different angles corresponding to the second joint portions, the cam members being configured to sequentially contact the second joint portions, thereby sequentially moving the second joint portions in the arrangement direction, as the shaft is rotated by the motor.

7. An inkjet printer according to claim 1, wherein the holding member comprises a locking member for fixedly locating the ink cartridges in the predetermined positions.

8. An inkjet printer according to claim 4, wherein the holding member comprises a locking member for fixedly locating the ink cartridges in the predetermined positions.

9. A method for connecting a plurality of ink cartridges and a plurality of joint portions in an inkjet printer which comprises the ink cartridges, which each contains an ink and to which a storage medium stored with information on the ink are attached, and a cartridge holder, which holds the ink cartridges and comprises the joint portions connected individually to the ink cartridges, the connecting method comprising:

a step of setting the ink cartridges in predetermined positions separate from the joint portions of the cartridge holder;

a step of reading the storage medium of the ink cartridges set in the predetermined positions and determining whether or not the ink cartridges are adaptive; and a step of moving the joint portions toward the ink cartridges, thereby connecting the joint portions and the ink cartridges, after all the ink cartridges set in the predetermined positions of the cartridge holder are determined to be adaptive.

10. A connecting method according to claim 9, wherein the joint portions and the ink cartridges are connected simultaneously.

11. A connecting method according to claim 9, wherein the joint portions and the ink cartridges are connected sequentially.

12. A method for connecting a plurality of ink cartridges and a plurality of joint portions in an inkjet printer which comprises the ink cartridges, which each contains an ink and to which a storage medium stored with information on the ink are attached, and a cartridge holder, which holds the ink cartridges and comprises the joint portions connected individually to the ink cartridges, the connecting method comprising:

a step of setting the ink cartridges in predetermined positions separate from the joint portions of the cartridge holder;

a first determination step of determining whether or not all the ink cartridges are set in the predetermined positions of the cartridge holder;

a second determination step of determining whether or not the storage medium are read from one or more ink cartridges, if any, determined not to be set in the predetermined positions of the cartridge holder in the first determination step;

a third determination step of reading the storage medium of the ink cartridges other than the ink cartridges of which the storage medium are not read and determining whether or not the read ink cartridges are adaptive if it is determined in the second determination step that the ink cartridges of which the storage medium are not read are not set in the predetermined positions of the cartridge holder; and a step of moving the joint portions toward the read ink cartridges, thereby connecting the joint portions and the ink cartridges, after all the read ink cartridges are determined to be adaptive in the third determination step.

13. A connecting method according to claim 12, wherein the joint portions and the ink cartridges are connected simultaneously.

14. A connecting method according to claim 12, wherein the joint portions and the ink cartridges are connected sequentially.

15. A connecting method according to claim 12, wherein the respective storage media of all the ink cartridges set in the predetermined positions of the cartridge holder are read and it is determined whether or not the ink cartridges are adaptive if it is determined in the first determination step that all the ink cartridges are set in the predetermined positions, and the joint portions are moved toward the ink cartridges so that the joint portions and the ink cartridges are connected after all the ink cartridges are determined to be adaptive.

16. A connecting method according to claim 12, wherein an error is indicated if the storage medium are read from the ink cartridges which are not determined to be set in the predetermined positions of the cartridge holder in the second determination step.

* * * * *